United States Patent [19]

Mitchell et al.

[11] 4,080,953

[45] Mar. 28, 1978

[54] ELECTROCHEMICAL HEATING DEVICE

[75] Inventors: William C. Mitchell, Arden Hills; Gregory R. Wyberg, Minneapolis, both of Minn.

[73] Assignee: Minnesota Mining and Manufacturing Company, St. Paul, Minn.

[21] Appl. No.: 748,760

[22] Filed: Dec. 8, 1976

[51] Int. Cl.[2] ..... F24J 1/04

[52] U.S. Cl. ..... 126/263; 44/3 A; 126/204

[58] Field of Search ..... 126/263, 400, 204; 44/3 R, 3 A, 3 B, 3 C; 252/70; 128/82.1

[56] References Cited

U.S. PATENT DOCUMENTS

| | | | |
|---|---|---|---|
| 3,301,250 | 1/1967 | Glasser | 126/263 |
| 3,774,589 | 11/1973 | Kober | 126/263 |
| 3,906,926 | 9/1975 | Staples | 126/263 |
| 3,976,049 | 8/1976 | Yamashita et al. | 126/263 |
| 3,980,070 | 9/1976 | Krupa | 126/263 |
| 3,998,749 | 12/1976 | Hydro et al. | 252/70 |

*Primary Examiner*—Edward G. Favors
*Attorney, Agent, or Firm*—Cruzan Alexander; Donald M. Sell; Roger R. Tamte

[57] ABSTRACT

A heating device is taught which includes a subdivided electrochemical cell comprising subdivided metal pieces which serve as the anode and conductive cathode layers coated on the anode pieces. When such coated pieces are enveloped in a liquid electrolyte, heat is generated by electrochemical-cell reactions; and the reactions and accompanying production of heat are accelerated by the direct electrical contact between the anode pieces and cathode layers. The cathode layers can be coated on the anode pieces either prior to assembly of the heating device, or in situ after the device has been activated. In the latter case, plating is accomplished through the presence in the liquid electrolyte of a plating salt that reacts with the metal anode pieces and produces an electroless deposition on the pieces.

14 Claims, 5 Drawing Figures

ELECTROCHEMICAL HEATING DEVICE

INTRODUCTION

The present invention is directed to heating devices having uses such as taught in Cambridge, U.S. Pat. No. 3,314,413; Glasser, U.S. Pat. No. 3,301,250; Staples, U.S. Pat. No. 3,906,926; and Chapin, U.S. Pat. No. 3,924,603. All of these patents teach so-called "flameless" heating devices, generally in the form of blankets that may be laid against an object to be heated and then activated, as by addition of water. While each of the prior devices has a certain utility, they all suffer from one or more important disadvantages: lack of control over heat production; insufficient length in the heating cycle; inadequate total heat output; high cost of manufacture; inconvenience and messiness in use; lack of reliability, etc.

The present invention improves over prior-art heating devices by producing heat with a unique, particulate or subdivided, electrochemical cell in which there is an electrical short circuit across the anode and cathode of the cell. Heating devices based on electrically shorted electrochemical cells are not new per se, having been suggested, for example, in Kober, U.S. Pat. No. 3,774,589 (heating blanket) and in McCartney, U.S. Pat. No. 3,884,216 (series of stacked plates, as in a vehicle battery). These prior-art devices were based on a recognition that the heat-producing electrochemical cell reactions are accelerated by the shorting paths, which provide a highly efficient transfer of electrons between the cathode and anode.

But the prior-art shorted electrochemical cells do not answer several important needs in flameless heating devices. For example, Kober teaches a "sandwich" or layered-type of heating blanket that comprises a metal foil anode layer; an activated carbon cathode layer; a cotton batting separator layer disposed between the anode and cathode and impregnated with salt; and shorting members, such as staples or rivets, extending between the anode and the cathode. This device is deficient in several respects that limit its utility, e.g. in shelf-stability, because the shorting members are susceptible to corrosion; in conformability, because of the stiffness of the metal foil, which leads to imperfect heat transfer; in cost, because of costly components and assembly methods; and in heat output, because the layered nature of the structure limits the amount of heat that can be generated from a heating blanket of given surface area. Similar deficiencies are found in the rigid stacked-plate device taught in McCartney; for example, such a device would never be adapted to conformable wrapping around articles to be heated, which is a major desire for flameless heating devices.

SUMMARY OF THE INVENTION

A heating device of the present invention includes an electrochemical cell in which the anode comprises subdivided metal pieces and the cathode comprises coatings on the metal pieces. The heating device may be assembled with the cathode layers already coated on the subdivided anode metal, or the cathode layers can be plated onto the anode metal in situ after activation of the heating device by inclusion of a plating salt in the electrolyte of the cell. The latter embodiment of the invention, which is preferred, especially because of its lower manufacturing cost, may be briefly summarized as generally comprising a container such as a flexible envelope in which are disposed 100 mole-parts of a mass of subdivided pieces of metal adapted to serve as the anode in an electrochemical cell; a water-soluble electrolyte salt present in an amount sufficient to provide a solution having a conductivity of at least 0.05 mho/centimeter when dissolved in 500 mole-parts of water; and at least 0.25 mole-part of a plating salt that provides metal ions adapted to react with the metal anode pieces in the conductive solution, whereupon the metal from the plating salt becomes plated onto the metal anode pieces to form the cathode of an electrochemical cell.

Such a preferred heating device of the invention is activated by mixing ingredients so as to envelop the metal anode pieces in the described conductive solution of electrolyte and plating salts. Typically, the activation is achieved by adding water, which is preferably either plain water or water in which the electrolyte salt, plating salt, or both, are dissolved. As an alternative, activation can be achieved by adding salts to water in which the metal anode pieces have previously been disposed; and the water added need not be pure, though many dissolved ingredients other than the electrolyte and plating salts may impede reaction.

Upon activation, heat is produced at a controlled rate. Although some heat will be produced simply by the direct reaction of the plating salt and the metal anode pieces, by far the largest proportion of the heat produced occurs through electrochemical reactions, including reduction of water to hydroxyl ions and hydrogen gas at the cathode and oxidation of anode metal at the anode. In general, at least 60 percent of the heat obtainable from the heating device (as calculated from thermodynamic equations), and preferably at least 90 percent, is produced through electrochemical reactions. The reactions are controlled by the conductivity of the solution and the availability at the anode and cathode of electrons or ions necessary for the reaction; the latter availability can in turn be controlled by the extent of the plating of the cathode on the metal anode. As a result of this control, heating devices of the invention are capable of producing a large and useful amount of heat very quickly and of maintaining that heat for a lengthy period of time such as an hour or more.

DETAILED DESCRIPTION

Figure 1:
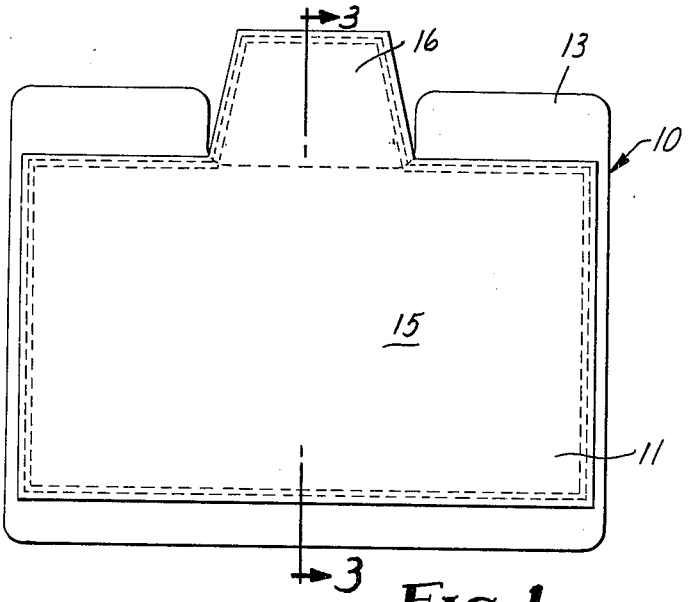
FIG. 1 is a sectional view through an illustrative heating blanket of the invention.
Figure 2:
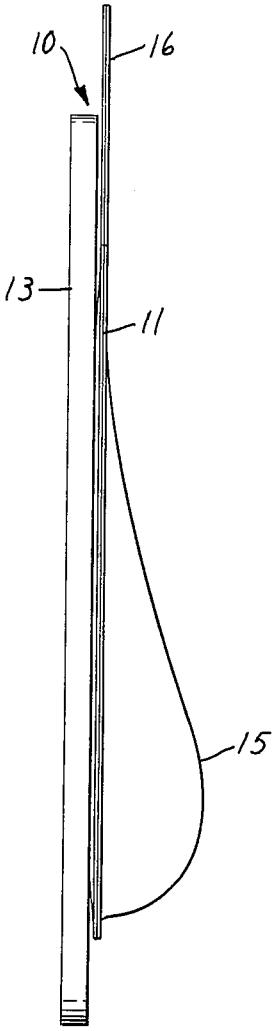
FIGS. 2 and 3 are end views and sectional views, respectively, of the heating blanket shown in FIG. 1.
Figure 3:
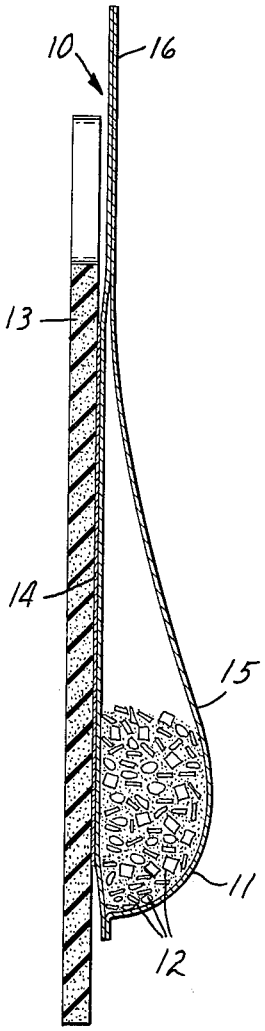

The illustrative heating blanket of the invention 10 illustrated in FIGS. 1–3 comprises a flexible envelope 11, subdivided or particulate ingredients 12 within the envelope, and a layer 13 of thermal insulation such as polymeric foam adhered to one side of the envelope by a layer 14 of adhesive. In use, the uncovered side 15 of the envelope 11 is placed against or wrapped around an article to be heated; and the layer 13 of insulation directs heat developed within the envelope to the article being heated, as well as protects persons handling the envelope.

The envelope 11 is most conveniently made from synthetic polymeric films such as polyethylene terephthalate; polyethylene; composite films of such polymers, as described in Charbonneau et al, U.S. Pat. Nos. 3,188,265 and 3,188,266; or polyvinyl chloride. The films may carry a metal film to reduce moisture penetration during storage. Such a metal film, which is typically applied by vapor-deposition, may be covered by a protective film. The polymeric films are typically sealed, welded, or adhesively bonded around their edges to form a sealed or impermeable structure. In the blanket shown in FIG. 1, the envelope 11 is shaped to provide a filling spout 16, and at least the sealed portions at the top of the spout are adapted to be separated to provide an opening through which the blanket can be activated, as by addition of water or electrolyte. The opening also serves as a vent allowing gaseous by-products of reactions in the blanket to escape.

The invention may take the form of other heating devices besides flexible blankets. For example, rigid containers can be used, so long as the container is adapted to be placed against an article and to transfer heat developed within the container to the article. Typically, the containers are shallow and rather extensive in surface area.

The ingredients within the blanket 10 shown in FIGS. 1-3 include, as previously noted, a subdivided metal adapted to serve as the anode in an electrochemical cell. Such metals have a high electromotive force (greater than +1) and exhibit a low rate of direct reaction with plain water (on the order of the rate of reaction of magnesium with water, or slower). Useful metals include magnesium (preferred), aluminum (somewhat less preferred), titanium, and zirconium. To permit the best control of the reaction, the anode pieces should have at least one dimension greater than about 1 millimeter, though smaller pieces or powder can be used if a fast reaction is desired. Thin metal chips are preferred, such chips generally being less than a millimeter in thickness and less than 10 square centimeters on a side; preferably they are less than about 1 square centimeter on a side. Thin narrow ribbons, generally no more than a centimeter in width, can be used, as can wires or wire-segments. Sufficient metal is used to provide the desired total heat output, and all together comprises a free-flowing or flexible mass.

The cathode layer on the metal anode pieces comprises a metal that has a low electromotive force (less than +0.5). Particularly useful cathode metals are copper, tungsten, iron, and nickel. A convenient method for plating cathode metal onto the anode metal prior to assembly of the heating device is to sputter-coat, vapor-deposit, or chemically deposit a metal onto either the subdivided metal anode pieces, or onto a continuous sheet of the anode metal which is later cut into chips.

Especially useful metals for in situ plating on the anode metal pieces are copper, iron, or nickel, and convenient salts of such metals to use as the plating salt are the sulfates, chlorides, and nitrates. The salt of the plating metal should be in a particulate form and may be in very finely divided form in order to assist its dissolving.

Also included in a heating blanket as shown in FIGS. 1-3 is a salt which will dissolve in water to make a conductive electrolyte. Useful electrolyte salts for this purpose include sodium chloride, calcium chloride, and sodium nitrate. In general, these materials dissociate in water to form high concentrations of mobile ions. Most often, the salt is included in dry powder form in the heating blanket, though it can be introduced in solution form at the time of activating the blanket; or be added to water already present in the blanket.

Figure 4:
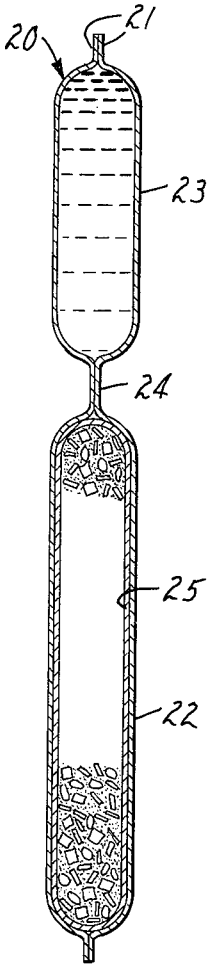
FIG. 4 is a cross-sectional view through a different illustrative heating blanket of the invention.

As shown in FIG. 4, a heating blanket of the invention 20 can be completely self-contained. In such a heating blanket, the envelope 21 has two pouches, one pouch, 22, containing at least the metal anode pieces, and the other pouch, 23, containing at least the electrolyte or water from which the electrolyte is formed. The blanket 20 is activated by breaking the seal 24 between the pouches. Envelopes as shown in FIG. 4, in which two pouches are separated by a rupturable or separable seal, are quite common and their method of manufacture is known in the art.

The proportions of the various ingredients can be varied to obtain different results, e.g. different rates of reaction, different amounts of heat, etc. Where metal anode pieces are used that have been preplated with a cathode layer, the cathode layer generally covers at least 15 percent, but less than 85 percent, of the surface of the anode pieces; plating of 50 percent of the surface is conveniently achieved by plating one side of a sheet that is later cut up, and such a percentage of plating provides a rate of heating useful for many kinds of jobs for heating devices of the invention. Where the plating salt is used to provide in situ coating of the anode pieces, it is generally used in an amount of at least 0.25 mole-part, and preferably at least 0.5 mole-part, per 100 mole-parts of the metal anode pieces. On the other hand, the amount of plating salt should be within a range such that at least 60 percent of the heat obtainable by complete reaction of the ingredients will be produced by electrochemical cell reactions. The plating salt will generally amount to less than 50 mole-parts, and preferably less than 5 mole-parts, per 100 mole-parts of anode pieces. Where steady long-term heating is desired, there is generally no advantage in use of more than 10 mole-parts of plating salt per 100 mole-parts of anode pieces.

Figure 5:
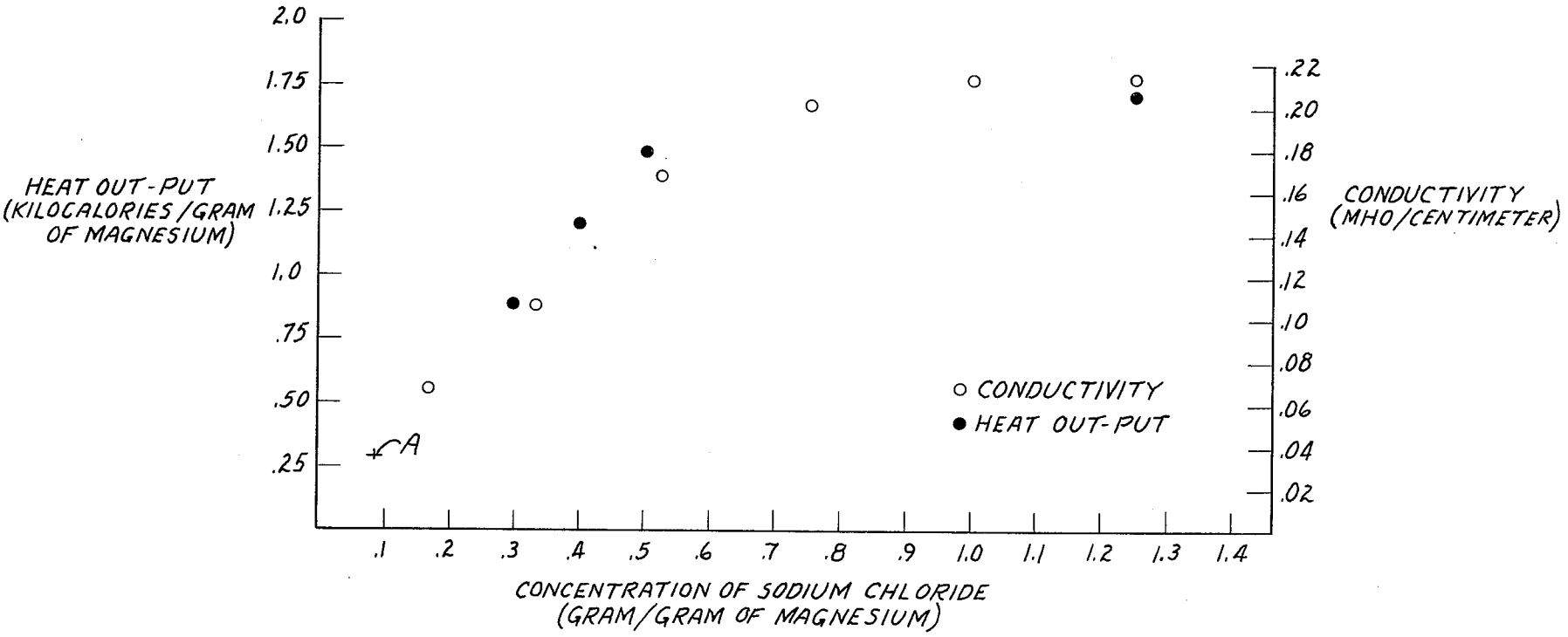
FIG. 5 is a plot of heat output and electrical conductivity of heating devices of the invention which include different amounts of the electrolyte salt.

The electrolyte salt in a heating blanket of the invention can also be varied to obtain different results. Such a variation in results is indicated in FIG. 5, which provides two plots: first, a plot of the total amount of heat produced during the first 10 minutes after activation of a set of heating blankets of the invention as described in Example 5, each containing a different amount of sodium chloride in the electrolyte (solid points); and secondly, a plot of the conductivity of the solution at the different amounts of sodium chloride (hollow points). The values plotted are per gram of magnesium anode pieces and are for use of 3 milliliters of water per gram of the magnesium. As may be seen, the greater the amount of sodium chloride in the solution, the greater the conductivity, and the greater the output of heat. At a conductivity represented by point A on the curve, which corresponds to the conductivity of sea water, there is very little output of heat. This conductivity does not provide sufficiently rapid reduction of water to hydroxyl ions and hydrogen gas at the cathode and oxidation of metal at the anode. However, when the conductivity reaches a level of 0.05 mho/centimeter, then the electrochemical reactions begin to occur with sufficient rapidity to produce a desired rate of heating, and highest heat output is generally obtained with conductivities of 0.1 mho/centimeter or more.

Heating blankets of the invention preferably include porous components that control diffusion of the reactants within the heating blanket. For example, the illustrative heating blanket shown in FIGS. 1-3 preferably includes porous particulate fillers such as vermiculite, which is believed to control and assure distribution of water in the heating blanket (i.e. the passage of water is not choked off at folds of the envelope, since the porous structure is present between the opposite sheets of the envelope).

Particles of manganese dioxide (such as the commercially available "Manganor," supplied by Combustion Engineering) have also been found a useful component to increase the heating rate at low temperatures. It is desired to include such particles in a weight amount equal to at least 10 percent by weight of the metal anode pieces and preferably in an amount equal to at least 20 percent of the weight of the metal anode pieces. Such porous fillers preferably account for at least about 10 weight-percent, and usually less than about 30 weight-percent of the particulate ingredients within a heating blanket as shown in FIGS. 1-3. The heating blanket shown in FIG. 4 uses a fibrous fabric, namely an inner sack 25 of a fabric such as cotton, instead of particulate porous materials to achieve desired diffusion of ingredients.

The invention will be further illustrated by the following example.

EXAMPLE 1

A heating blanket of the invention was prepared by placing a mixture that included 40 grams of magnesium chips that averaged about 0.25 millimeter in thickness and had average surface dimensions of about 4 millimeters by 6 millimeters and 15 grams of sodium chloride salt into a flat 5-inch-by-8-inch (12.5 centimeters by 20 centimeters) cotton pouch, and then placing the cotton pouch inside a plastic envelope. The magnesium chips carried a 5-micrometer-thick coating of copper covering about 50 percent of the area of each magnesium chip (i.e. the coating covered all of one side of a flat chip). The blanket was wrapped around the side of a sealed, water-filled polyethylene bottle and taped in place, after which a ¼-inch-thick (0.6 centimeter) layer of foam insulation was adhered over the exposed side of the blanket. The blanket was activated by adding 150 milliliters of water to the envelope, and the heat output produced in the blanket and delivered to the water in the bottle was monitored with a thermocouple immersed in the water. Heat delivered can be calculated from the measurement of temperature by using the specific heat of water.

As a comparison, another heating blanket like that just described, except that the magnesium chips were not coated with copper, but were left uncoated, was prepared and measured for heat output. The heating blanket of the invention delivered 40 times more heat in 1 hour than the comparative heating blanket.

EXAMPLE 2

A heating blanket as described in Example 1 was prepared except that the magnesium chips were coated with tungsten over about 50 percent of their area instead of with copper. The heat delivered to the load was similar to that delivered by the copper-coated chips as shown in the following table:

| Time (minutes) | Heat delivered to load: Example 1 (calories/gram of magnesium) | Heat delivered to load: Example 2 (calories/gram of magnesium) |
|---|---|---|
| 7 | 350 | 350 |
| 20 | 700 | 650 |
| 60 | 800 | 675 |

EXAMPLE 3

A heating blanket was prepared and tested in the manner described in Example 1, except that the magnesium chips were uncoated and the water added to the heating blanket included 8 grams of $CuCl_2.2H_2O$. The latter served as a plating salt, with copper ions from the salt producing an electroless deposition on the magnesium chips; and the deposited layer then served as a cathode for acceleration of the electrochemical reaction. The electroless deposition was itself exothermic, but thermodynamic calculations show that the energy contributed by that exothermic reaction was no more than 6 percent of the energy available from the complete electrochemical oxidation of magnesium by water. The following heating rate was observed:

| Time (minutes) | Heat delivered to load (calories/gram of magnesium) |
|---|---|
| 7 | 300 |
| 20 | 675 |
| 60 | 900 |

EXAMPLE 4

A heating blanket was prepared that included, per square inch (6.5 square centimeters) of the surface area of the blanket, 1 gram of magnesium chips that averaged 4 millimeters by 6 millimeters by 0.25 millimeter in size, 0.4 gram of ferric sulfate, 1.25 gram of sodium chloride, 0.3 gram of vermiculite, and 0.3 gram of manganese dioxide ("Manganor" supplied by Combustion Engineering). One-hundred-fifty milliliters of water were added to the heating blanket to activate the heating blanket, and heat was generated and delivered to the load in an amount of 525 calories/gram of magnesium over a period of 20 minutes.

EXAMPLE 5

To illustrate the variation that occurs in heat output depending on the amount of plating salt present in the blanket, a set of heating blankets were prepared of the type generally described in Example 4 except that the blankets had an area of 12 square inches (78 square centimeters) instead of 40 square inches (260 square centimeters), and the amount of ingredients was correspondingly reduced (so there was still one gram of magnesium per 6.5 square centimeters of surface area). The amount of ferric sulfate in the blankets varied from zero to 0.7 gram per gram of magnesium chips. To minimize heat losses to the ambient environment and thus cause more heat to be delivered to the load, each blanket was attached to two polyethylene bags filled with a total of 200 grams of water, with the temperature of the water being monitored with a thermocouple, and the bags then placed in a polystyrene container. The results are shown in the following table:

| Parts of ferric sulfate (grams) | Heat delivered to load after 10 minutes (calories/gram of magnesium) |
|---|---|
| 0 | 50 |
| 0.05 | 750 |
| 0.1 | 1500 |
| 0.2 | 1250 |
| 0.3 | 1525 |
| 0.4 | 1575 |
| 0.5 | 1775 |
| 0.67 | 1700 |

(When "Manganor" was omitted as well as ferric sulfate from a heating blanket as described in Example 4, the heat delivered to the load after 10 minutes was only 5 calories per gram of magnesium).

EXAMPLE 6

Two heating blankets were prepared and tested as described in Example 5 except that no vermiculite and no "Manganor" were included in the formulation and in one of the blankets the magnesium chips were replaced with an equal weight amount of magnesium powder (100 percent passed a 40 mesh, U.S. Standard screen). The average heating rate obtained from the two blankets is given in the following table to illustrate that larger-sized anode metal pieces provide a longer heating cycle.

| Time interval (minutes) | Average heating rate during different time intervals (calories/gram of magnesium/minute) | |
|---|---|---|
| | Magnesium powder | Magnesium chips |
| 0–5 | 332 | 227 |
| 5–10 | 5 | 82 |
| 10–20 | 6.5 | 33 |

What is claimed is:

1. A shelf-stable electrochemical heating device capable of generating heat at a controlled rate comprising a container adapted to be placed against an article so as to transfer heat developed within the container to the article; and disposed within the container, 100 mole-parts of a mass of subdivided pieces of a metal adapted to serve as the anode in an electrochemical cell; a water-soluble salt present in an amount sufficient to provide a solution having a conductivity of at least 0.05 mho/centimeter when dissolved in 500 mole-parts of water; and cathode means selected from the group consisting of (1) coatings of electrically conductive metal on the metal anode pieces covering between about 15 and 85 percent of the surface area of the pieces, and (2) at least 0.25 mole-part of a plating salt that provides metal ions adapted to react with said metal anode pieces in said conductive solution and form a coating of the metal on the pieces; at least 60 percent of the heat produced after mixing of the reactants and formation of said conductive solution being produced through electrochemical reactions, including reduction of water to hydroxyl ions and hydrogen gas at the cathode and oxidation of the anode metal pieces.

2. A heating device of claim 1 in which a porous inert flexible structure is included in the container in a weight amount equal to at least 10 percent of the weight of the metal anode pieces.

3. A heating device of claim 2 in which said porous inert flexible structure comprises particles of vermiculite.

4. A heating device of claim 2 in which said porous inert flexible structure comprises a fibrous fabric.

5. A heating device of claim 1 in which the cathode means consists of said coatings of electrically conductive metal covering about 50 percent of the surface area of the metal anode pieces.

6. A heating device of claim 1 in which the container is divided into two compartments separated by a rupturable barrier, and liquid ingredients are stored in one compartment and the metal anode pieces are stored in the other compartment.

7. A shelf-stable electrochemical heating blanket capable of producing heat at a controlled rate comprising a flexible envelope adapted to be wrapped around an article so as to transfer heat developed within the envelope to the article, and disposed within the envelope, 100 mole-parts of a mass of subdivided pieces of a metal adapted to serve as the anode in an electrochemical cell; a water-soluble salt present in an amount sufficient to provide a solution having a conductivity of at least 0.05 mho/centimeter when dissolved in 500 mole-parts of water; and at least 0.25 mole-part of a plating salt that provides metal ions adapted to react with said metal anode pieces in said conductive solution to form a coating of metal on the pieces that serves as the cathode of an electrochemical cell; at least 60 percent of the heat obtainable after activation of the cell by mixing of the listed ingredients and formation of said conductive solution being produced through electrochemical reactions including reduction of water to hydroxyl ions and hydrogen gas at the cathode and oxidation of the anode metal pieces.

8. A heating blanket of claim 7 in which a porous inert flexible structure is included in the blanket in a weight amount equal to at least 10 percent of the weight of the metal anode pieces.

9. A heating blanket of claim 8 in which said porous inert flexible structure comprises particles of vermiculite.

10. A heating blanket of claim 8 in which said porous inert flexible structure comprises a fibrous fabric.

11. A heating blanket of claim 7 in which said metal anode pieces are thin metal chips selected from magnesium and aluminum.

12. A heating blanket of claim 7 which further includes particles of manganese dioxide distributed within the blanket in a weight amount equal to at least 10 percent of the weight of the metal anode pieces.

13. A shelf-stable electrochemical heating blanket capable of generating heat at a controlled rate comprising a flexible envelope adapted to be wrapped around an article so as to transfer heat developed within the envelope to the article, and disposed within the envelope, 100 mole-parts of thin metal chips having surface dimensions between about 0.1 and 1 centimeter and selected from magnesium and aluminum; a water-soluble salt present in an amount sufficient to provide a solution having a conductivity of at least 0.05 mho/centimeter when dissolved in 500 mole-parts of water; at least 0.25 mole-part of a plating salt that provides metal ions adapted to react with said metal anode chips in said conductive solution to form a coating of metal on the chips that serves as the cathode of an electrochemical cell; and a porous inert flexible structure disposed inside the blanket in a weight amount equal to at least 10 percent of the weight of the metal anode chips; at least 60 percent of the heat obtainable from the blanket after activation by mixing said ingredients and enveloping the metal chips in conductive solution being produced through electrochemical reactions including reduction of water to hydroxyl ions and hydrogen gas at the cathode and oxidation of the anode metal chips.

14. A heating blanket of claim 13 which further includes particles of manganese dioxide distributed within the blanket in a weight amount equal to at least 10 percent of the weight of the metal anode chips.

* * * * *